US005092601A

United States Patent [19]

Rilling

[11] Patent Number: 5,092,601

[45] Date of Patent: Mar. 3, 1992

[54] PIVOT TRAINER FOR GOLFERS

[75] Inventor: John F. Rilling, Roswell, Ga.

[73] Assignee: Golf Research Technology, Inc., Norcorss, Ga.

[21] Appl. No.: 682,569

[22] Filed: Apr. 9, 1991

[51] Int. Cl.[5] ..... A63B 69/36; G08B 21/00

[52] U.S. Cl. ..... 273/183 B; 340/573; 200/61.45 R; 128/782

[58] Field of Search ..... 273/183 B, 186 R, 186 A, 273/26 C, 29 A; 340/573, 574, 575, 669; 200/61.45

[56] References Cited

U.S. PATENT DOCUMENTS

| | | | |
|---|---|---|---|
| 2,191,683 | 2/1940 | Roberts | 273/183 B |
| 3,156,211 | 11/1964 | Mallory | 273/183 B |
| 3,614,763 | 10/1971 | Yannuzzi | 340/573 X |
| 3,644,919 | 2/1972 | Mathauser | 340/573 |
| 3,808,707 | 5/1974 | Fink | 273/26 C X |
| 5,005,835 | 4/1991 | Huffman | 273/183 B |

*Primary Examiner*—George J. Marlo

*Attorney, Agent, or Firm*—Trexler, Bushnell, Giangiorgi & Blackstone, Ltd.

[57] ABSTRACT

A pivot trainer useful in learning a proper golf swing pivot comprises an electronic circuit having a unique transducer. The pivot trainer is designed to be worn by the golfer in proximity to his hips, because the pivot trainer monitors effective hip movement. The transducer comprises an electrically conducting movable element. The transducer translates about the electrically conducting movable element, which is held stationary within the transducer under the influence of inertial forces generated by golfer hip rotation. If the hips are properly rotated, and the golfer pivots properly, a variable element contacts a movable element, completing the circuit, causing a feedback signal to issue therefrom. The variable element can be positioned in a plurality of positions within the transducer, thus changing the amount of inertia needed to complete the circuit. This allows the golfer to progress from his currently employed swing to a more effective golf swing.

17 Claims, 2 Drawing Sheets

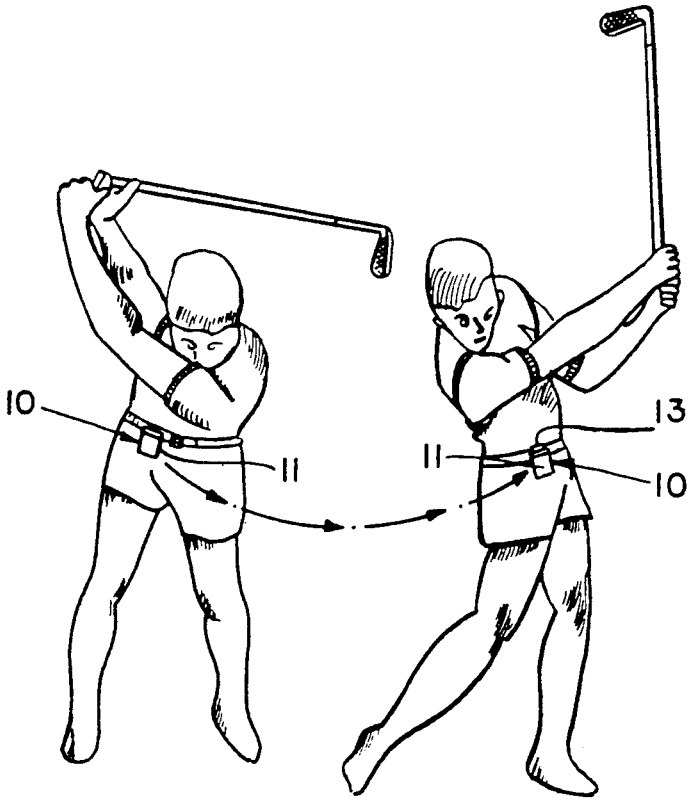
FIG. 1
FIG. 5
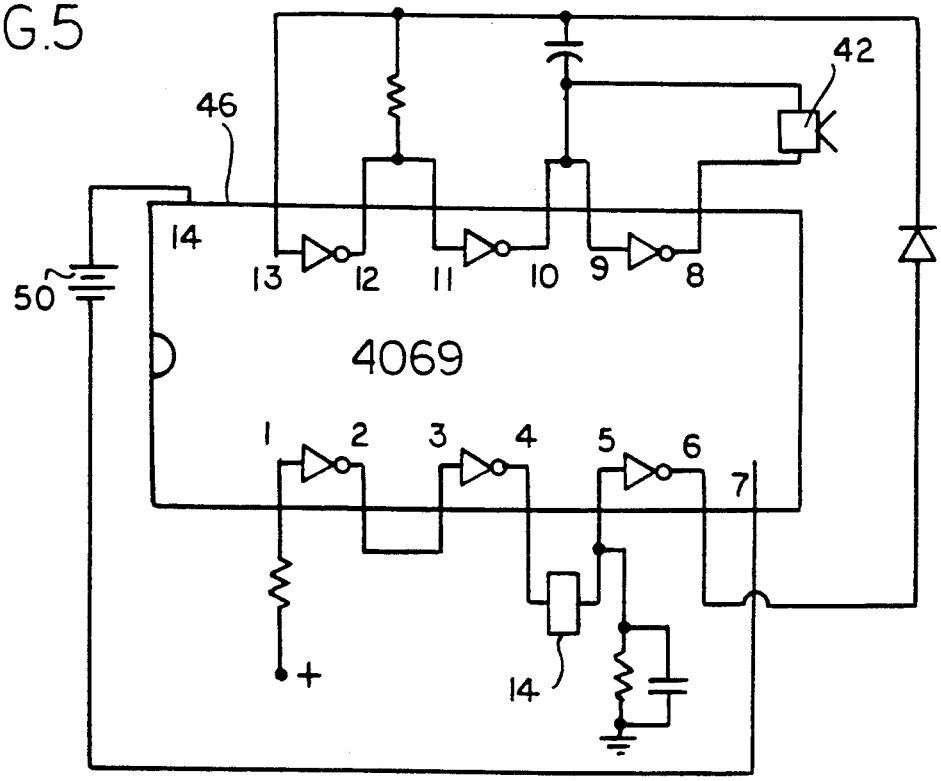

PIVOT TRAINER FOR GOLFERS

BACKGROUND AND SUMMARY OF THE INVENTION

This invention relates generally to a pivot trainer that assists a golfer in learning a proper golf swing pivot. Many golfers are haunted by the adverse effects and consequences of an errant golf swing caused by an improper rotation or pivot of the hips. Often, a golfer is prone to hold his hips stationary, and uses his feet to slide through his golf swing. This sliding produces an errant golf swing because the golfer's weight is not transferred properly from one leg to the other. Also, sliding renders the golfer off-balance when the golf club strikes the golf ball, thus reducing the golfer's accuracy in placing the ball on the fairway or the green. Further, the power present in a golf swing produced by a sliding golfer is not maximized, resulting in an errant stroke, and a golf ball trajectory of lesser distance. The errant swings caused by sliding serve to produce higher golf scores, and increase golfer frustration with the game.

Many golfers, in hopes of improving their golf game attempt to practice the desired movement, but find it difficult to tell whether they are obtaining the proper pivot action. Therefore, many golfers desire a means for learning a proper golf swing pivot that will provide them with a definitive indication of their progress toward, the desired, proper pivot action.

In addition, many golfers need an educational means that they can use progressively. That is, a means for learning a proper golf swing pivot, or pivot trainer, that can be used to instruct the golfer, in the beginning, at a basic, easy to learn level, and then, once the golfer has mastered the basics, a means that can be used to instruct the golfer at a progressively more advanced level. This means is desired also to learn an appropriate downswing of the golf club, because the faster a golfer pivots his hips throughout the swing, the better his swing will become, resulting in greater power imparted to the golf ball, as well as greater accuracy of the stroke. Preferably, the educational means should provide some method of feedback to the golfer, so that the golfer will immediately know if he has pivoted properly, or not. Such a means, if used consistently and properly, has the possibility of assisting in decreasing a golfer's golf score, and increasing his enjoyment of the game.

OBJECTS AND SUMMARY OF THE INVENTION

A general object of the invention is to provide a pivot trainer that can assist a golfer in improving his golf swing pivot.

Another object of the invention is to provide a pivot trainer that will be less expensive to the golfer than many other, currently available, means for learning a proper golf swing pivot.

A further object of the present invention is to provide a pivot trainer that can be used to instruct a golfer at various levels of difficulty.

An additional object of the invention is to provide a pivot trainer that can be used to instruct a golfer not to slide through his golf swing.

Another object of the present invention is to provide a pivot trainer that can be used to improve a golfer's balance and weight transfer during his golf swing.

A further object of the invention is to provide a pivot trainer that can be used to instruct a golfer to maximize the power of his golf swing.

An additional object of the present invention is to provide a pivot trainer that can supply a golfer with feedback to indicate whether the golfer's pivot is proper or not.

The pivot trainer, constructed according to the teachings of the present invention, is a unique device for teaching a golfer how to pivot properly during a golf swing. The elements of the pivot trainer are disposed within a container, similar in size to a pager beeper, which is adapted to be clipped to the golfer's waistband.

The pivot trainer is comprised of an electric or electronic circuit having a unique transducer. The transducer is comprised of a first electrically conducting terminal, an electrically conducting spring contacting the first terminal, and an electrically conducting movable element contacting the electrically conducting spring, and a second spring. The second spring contacts a base, and the base has a second electrical contact, or an electrically conducting variable element such as a screw, disposed through the base. The screw is connected electrically to a second terminal. All of these elements are contained within a bore inside a housing. The transducer is connected to the circuit by means of electrical connectors connected to the first and second terminals. When a golfer pivots properly, inertia working on the electrically conducting movable element, causing that element to remain stationary, while the transducer moves due to the rotation of the golfer's hips, will cause the movable element to be compressed against the second spring, and to contact the electrically conducting screw. This completes the circuit of the pivot trainer, and allows it to issue a feedback signal to the golfer, indicating that he has pivoted properly. The length of the screw within the bore is adjustable, so as to allow the golfer to adjust the level of difficulty of instruction.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which:

FIG. 1 is a sequential view of a golfer using the pivot trainer to learn a proper pivot for use during his golf swing;

FIG. 5 is a schematic diagram of the electronic circuit employed by the pivot trainer.

DETAILED DESCRIPTION OF THE PREFERRED EMBODIMENT

Figure 2:
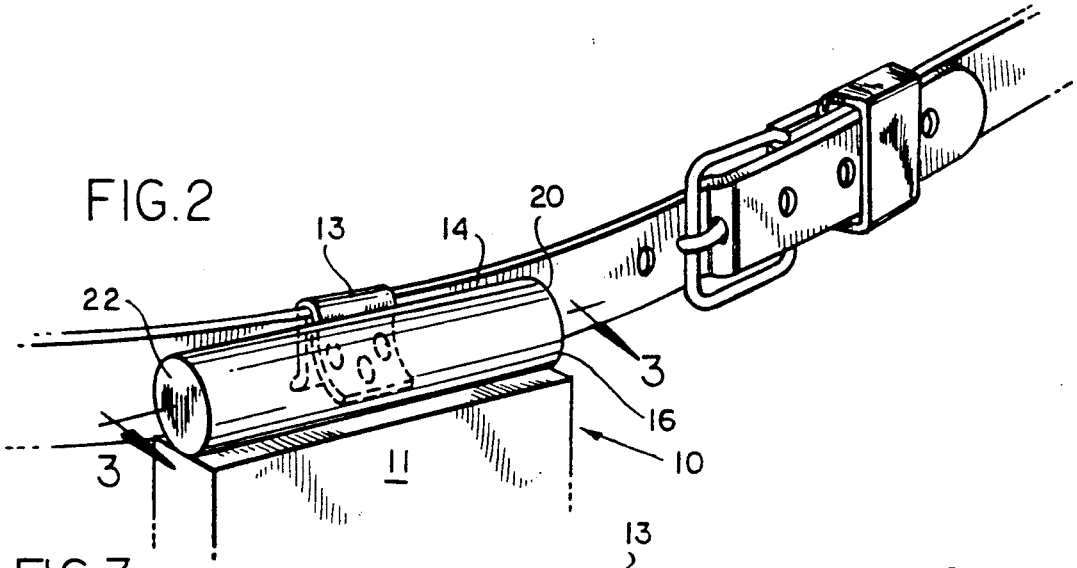
FIG. 2 is an enlarged fragmentary perspective view of the pivot trainer, showing the particular disposition of the pivot trainer on the golfer's waist.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

The pivot trainer 10 comprises an electronic circuit 12 having a uniquely designed transducer 14. The circuitry of the pivot trainer 10 are disposed within a container 11, similar in size to a pager beeper, having attaching means 13, which allows the pivot trainer 10 to be attached to the waist of a golfer, as shown in FIG. 2.

Figure 3:
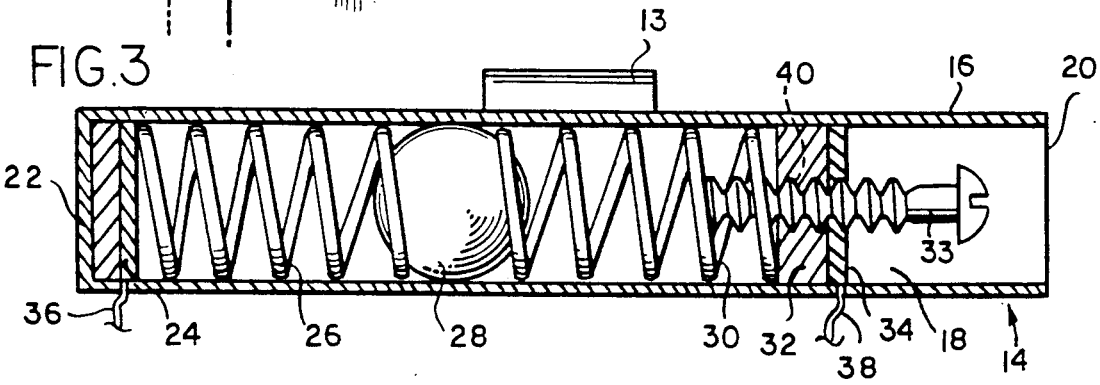
FIG. 3 is a further enlarged sectional view, taken along line 3—3 of FIG. 2, showing the particular disposition of the elements of the transducer, when the pivot trainer is at rest.

Referring generally to FIG. 3, the particular structure of the transducer 14 is disclosed. The transducer 14 is comprised of a housing 16 having a bore 18, disposed centrally about the axis of elongation of the housing 16. The bore 18 is disposed throughout the entire length of the housing 16, leaving, however, one end of the housing 16 intact. With this disposition, the housing 16 has an open end 20, and a closed end 22.

The bore 18 is of sufficient size so as to allow for the disposition of a first terminal 24, a conducting spring 26, a first electrical contact, or movable element 28, a second spring 30, a base 32, a second extendible and retractable electrical contact, or variable element 33, and a second terminal 34 within the bore 18. The first terminal 24 is disposed upon the closed end 22 of the housing 16, and extends to fill the cross section of the bore 18 at the closed end 22. The first terminal 24 is connected electrically or electronically to the remainder of the electronic circuit 12 by means of a first electrical connector 36.

The electrically conducting spring 26 is disposed next to the first terminal 24, and contacts the first terminal 24 so as to form an electrical connection between the electrically conducting spring 26 and the first terminal 24. The movable element 28 is disposed next to, and contacts the conducting spring 26. The movable element 28 is constructed of an electrically conducting material, so that the first terminal 24, the conducting spring 26, and the movable element 28 form an extension of the first electrical connector 36, and thereby an extension of the electronic circuit 12.

The second spring 30 is composed of a conducting material and is disposed within the bore 18 between the movable element 28, and the base 32. The second spring 30 contacts both the movable element 28, and the base 32. Disposed upon the base 32, on the side opposite to the second spring 30, is an electrically conducting second terminal 34, which is connected electrically or electronically to the remainder of the electronic circuit 12 by means of a second electrical connector 38. Both the base 32 and the second terminal 34 extend to fill the entire cross section of the bore 18 at the open end 20 of the housing 16. The base 32 is constructed of an electrically insulating plastic or other material, so that the spring 30 is electrically insulated from the terminal 34.

The base 32 and the second terminal 34 have an aperture 40 disposed through both of them. The aperture 40 preferably is threaded so as to accept the variable element, or screw, 33, which also is threaded in the preferred construction. The variable element 33 is capable of threadible translation through the aperture 40, thus varying the length of the variable element 33 disposed within the bore 18, between the base 32 and the movable element 28. The variable element 33 is made from an electrically conducting material, and is constructed of such a form so as to extend electrically the second electrical connector 38, and to be able to complete an electrical connection between the movable element 28 and the variable element 33, so that the electronic circuit 12 can be completed electrically. Thus, the variable element 33 forms a means for adjusting the difficulty of instruction of the pivot trainer 10.

As shown in FIG. 5, the transducer 14, as disclosed above, is an integral element of the electronic circuit 12. The electronic circuit 12 has a signaling means 42, such as a speaker or the like, which is actuated by the circuit 12 when the electronic circuit 12 is completed. This signaling means 42 is capable of providing feedback to the golfer, instructing him regarding a proper pivot for a golf swing. The electronic circuit 12 allows the signaling means to be actuated for a time period of the order of one and one-half seconds, after which the circuit 12 resets itself, preparing the pivot trainer 10 for the next golf swing.

The particular construction of the electronic circuit 12 is shown schematically in FIG. 5. The electronic circuit 12 is comprised of an integrated circuit chip 46, similar to a 4069 chip, which is well known, bearing a plurality of inverting amplifiers, a transducer 14, constructed according to the teachings of this invention, signaling means 42, and a nine volt power source 50, such as an alkaline battery. The transducer 14, when the movable element 28 contacts the variable element 33, allows current to flow through the electronic circuit 12 to actuate the signaling means 42. The electronic circuit 12 actuates the signaling means 42 of a period of time on the order of one and one-half seconds, after which, the electronic circuit 12 is ready for the next swing.

Figure 4:
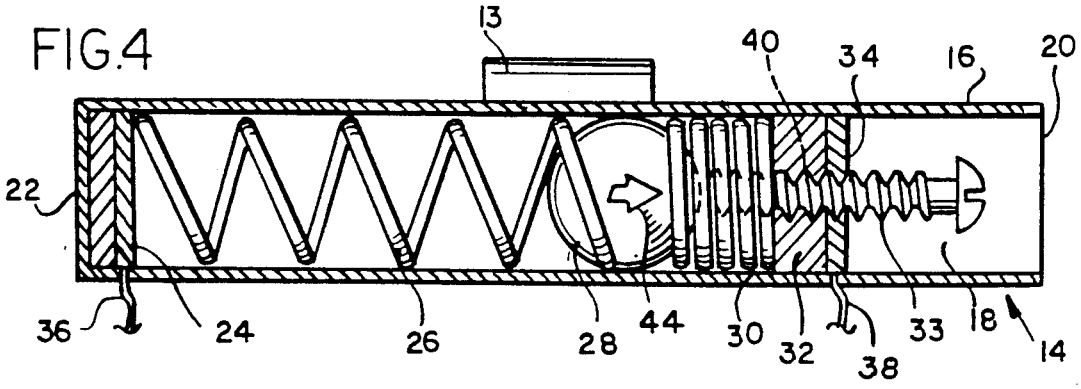
FIG. 4 is a sectional view, similar to that of FIG. 3 taken along line 3—3 of FIG. 2, showing the particular disposition of the elements of the transducer, when the pivot trainer is under the influence of a force generated by the proper rotation of a golfer's hips, with inertia acting upon the electrically conducting movable element.

Referring generally to FIG. 3, and FIG. 4, the method of operation of the pivot trainer 10 will become more clear. First, the golfer attaches the pivot trainer 10 to his belt or waistband. It is important that the golfer attach the pivot trainer 10 close to his hip, because it is the proper rotation of the hips throughout the swing that leads to an appropriate golf swing pivot. The pivot trainer 10 should be attached to a golfer's waistband so that the screw 33 points towards the golfer's back. The proper disposition of the pivot trainer 10 upon the golfer is shown in FIG. 1.

With the pivot trainer 10 in position on the golfer, the golfer is ready to begin using the pivot trainer 10 to learn a proper golf swing pivot. The pivoting motion of the golfer's hips throughout his golf swing effects only the transducer 14 of the electronic circuit 12. The transducer 14 has the ability to transform the physical motion of the golfer's hips into an electric current which is capable of actuating the signaling means 42 within the electronic circuit 12.

As the golfer addresses the golf ball, the pivot trainer 10 is in the rest position, as shown in FIG. 3. The movable element 28 is not in contact with the variable element 33, and thus, no current can flow in the electronic circuit 12. When the golfer begins his backswing, as shown in FIG. 1, inertia causes the movable element 28 to remain stationary with respect to the housing 16. The rotation of the golfer's hips generates a force upon the housing 16 of the transducer 14. This force, combined with the inertia working upon the movable element 28, causes the housing 16 to translate backwards, thereby moving the first terminal 24 towards the movable element 28. Thusly, the conducting spring 26 is compressed, and thereby contacts the movable element 28.

Then, when the golfer begins his striking swing, the force generated by the golfer's hips during his backswing dissipates. This dissipation of force allows the conducting spring 26 to force the movable element 28 towards the base 32, and into contact with the second spring 30. However, the force imparted by the conducting spring 26 onto the movable element 28 is insufficient to propel the movable element 28 into contact with the variable element 33. This assures that the pivot trainer 10 will not issue an errant feedback signal to the golfer.

As the golfer progresses through his striking swing, the rotation of his hips, as shown in FIG. 1,. generates another force, causing the housing 16 to translate forward further, with respect to the golfer and the movable element 28, and inertia 44, shown by the horizontal arrow in FIG. 4, again maintains the movable element 28 stationary. The inertia 44 causes the base 32 to move towards the movable element 28, and causes the second spring 30 to contact the movable element 28.

If the golfer pivots his hips properly, the inertia 44 will be of sufficient magnitude to hold the movable element 28 stationary, thereby allowing the second spring 30 to contact the movable element 28, thereby compressing the second spring 30. When the second spring 30 has been compressed sufficiently, the movable element 28 comes into contact with the variable element 33. Once this contact has been established, the electronic circuit 12 is complete, wherein current is free to flow from the first electrical connector 36, across the conducting spring 26, to the movable element 28, through the variable element 33, to the second terminal 34, and across the second electrical connector 38 into the remainder of the electrical circuit 12. That current then can flow to the signaling means 42, actuating the signaling means 42, and causing the pivot trainer 10 to provide feedback to the golfer. If the golfer did not pivot his hips properly throughout his golf swing, the inertia 44 will be of insufficient magnitude to hold the movable element 28 stationary, thereby preventing compression of the second spring 30, and thus, no feedback will issue from the pivot trainer 10.

The golfer should finish his golf swing with a proper follow through, as shown in FIG. 1. When the rotation of the golfer's hips has ceased, the inertia 44 dissipates, allowing the transducer 14 to return to its at rest position, as shown in FIG. 3. The electronic circuit 12 allows the signaling means 42 to provide feedback to the golfer to a period of time of the order of one and one-half seconds, after which the electronic circuit 12 resets itself, so that the pivot trainer 10 is ready for the next swing.

One of the keys to a proper golf swing is the proper, fast pivoting of the hips. The pivoting of the hips of the golfer during his swing cannot be too fast—the faster, the better. So as the golfer progresses in skill, the golfer will want to pivot his hips faster and faster during his golf swing. The construction of the pivot trainer 10, and specifically the variable element 33, allows the golfer to progressively modify the amount of centrifugal force 44, and thereby the speed of his hips as they pivot through his golf swing, necessary to propel the variable element 33 into contact with the movable element 28 so that the pivot trainer 10 can actuate the signaling means 42.

To adjust the amount of inertia 44 necessary to actuate the transducer 14, all the golfer need do is to translate variably the variable element 33 through the aperture 40 in the base 32 and the second terminal 34. Doing this changes the length of the variable element 33 which protrudes through the base 32 and the second terminal 34 towards the movable element 28. This has the effect of altering the distance the second spring 30 must be compressed so that the movable element 28 can contact the variable element 33.

Because the second spring 30 will have to be compressed different distances so that the movable element 28 can contact the variable element 33, the amount of inertia 44 needed, and the speed of hip rotation throughout the golf swing necessary to provide feedback to the golfer is variable. In this manner, one who begins using the pivot trainer 10 can preset the variable element 33 so that feedback will issue from the pivot trainer 10 when a small amount of inertia 44 is imparted to the movable element 28 and the housing 16 moves slightly with respect to the movable element 28 due to rotation of the hips during the golf swing. As the golfer increases his skill, he can reset the variable element 33 progressively, so that he can increase gradually the speed of his hip pivot during his golf swing.

The pivot trainer 10 constructed according to the teachings of the present invention can assist a golfer in improving his golf swing pivot, teaching the golfer not to slide during his stroke, and improving his balance and weight transfer as he swings at the golf ball. In this manner, the golfer can learn how to maximize the power of his golf swing and his enjoyment of the game, while lowering his golf score. The pivot trainer 10 issues feedback to the golfer when he pivots properly, so that the golfer will know immediately if he has employed a proper golf swing. Also, the pivot trainer 10 can be used by the golfer progressively, beginning with the basics, and improving therefrom.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

THE INVENTION CLAIMED IS:

1. A pivot trainer useful in learning a proper golf swing pivot comprising: an electronic circuit having a transducer and signaling means; the transducer comprising a housing having a bore; a first terminal, an electrically conducting force imparting element, an electrically conducting movable element, a force imparting element, a base, a second terminal, and an electrically conducting variable element being disposed within the bore; the first terminal being disposed on one end of the bore; the electrically conducting force imparting element contacting the first terminal so as to form an electrical connection therebetween; the electrically conducting movable element being disposed next to, and in contact with the electrically conducting force imparting element so as to form an electrical connection therebetween; the force imparting element being disposed between the electrically conducting movable element and the base; the second terminal being disposed in proximity to the base; an aperture being disposed about the base and the second terminal; the aperture being of sufficient size to accept the variable element; the electrically conducting movable element, and the electrically conducting variable element being disposed within the bore so that the variable element may contact the movable element, thus completing the electronic circuit; and the signaling means being capable of providing feedback to a golfer regarding the correctness of his golf swing pivot while executing a golf club swing.

2. A pivot trainer as defined in claim 1 wherein the elements of the pivot trainer are disposed within a container; and the container having attaching means capable of attaching the container in proximity to the golfer's waist.

3. A pivot trainer as defined in claim 1 wherein the signaling means comprises an audio speaker.

4. A pivot trainer as defined in claim 1 wherein the force imparting element and the electrically conducting force imparting element comprise springs.

5. A pivot trainer as defined in claim 1 wherein the electrically conducting variable element is capable of translation within the bore so as to alter the distance the movable element must travel, with respect to the housing, to contact the variable element to complete the electronic circuit, and to vary the magnitude of inertia needed to permit the variable element to translate into contact with the movable element.

6. A pivot trainer as defined in claim 1 wherein the variable element comprises a screw.

7. A pivot trainer as defined in claim 1 wherein the force imparting element comprises a spring.

8. A pivot trainer as defined in claim 1 wherein the movable element comprises a ball bearing.

9. A pivot trainer for monitoring the pivotal movement of a golfer's hips while executing a golf swing comprising: a transducer including means for mounting same at the waist of a golfer and adapted to be actuated upon pivotal movement of the golfer's hips during a golf swing; signaling means responsive to actuation of the transducer for providing feedback to the golfer regarding the correctness of his golf swing pivot; said transducer comprising a first electrical contact, a second extendible and retractable electrical contact movable between a rest position spaced from the first electrical contact, and a second position in engagement with the first electrical contact in response to inertia developed during a golf swing, and said signaling means including an electronic circuit energizable upon engagement of the first and second electrical contacts.

10. A pivot trainer as defined in claim 9 which includes an electronic circuit incorporating the transducer, the transducer comprising an element movable in response to inertia for actuating the circuit.

11. A pivot trainer as defined in claim 9 wherein the elements of the pivot trainer are disposed within a container; and the container having attaching means capable of attaching the container in proximity to the golfer's waist.

12. A pivot trainer as defined in claim 9 wherein the signaling means comprises an audio speaker.

13. A pivot trainer as defined in claim 9 wherein the second electrical contact is movable, and the first electrical contact is capable of translation within the transducer so as to alter the distance the second electrical contact must travel to engage the first electrical contact, and to vary the magnitude of the inertia developed during a golf swing needed to permit the second electrical contact to engage the first electrical contact.

14. A pivot trainer as defined in claim 9 wherein the transducer contains means for prohibiting the first electrical contact from engaging the second electrical contact when an improper force, such as inertia generated by a backswing, is applied to the second electrical contact.

15. A pivot trainer as defined in claim 14 wherein the means for prohibiting the first electrical contact from engaging the second electrical contact when an improper force, such as inertia generated by a backswing, is applied to the second electrical contact comprises a spring.

16. A pivot trainer as defined in claim 9 wherein the second electrical contact comprises a screw.

17. A pivot trainer as defined in claim 9 wherein the first electrical contact comprises a ball bearing.

* * * * *